United States Patent [19]

McCammon et al.

[11] Patent Number: 4,556,772

[45] Date of Patent: Dec. 3, 1985

[54] MICROWAVE OVEN CAVITY AIR FLOW SYSTEM

[75] Inventors: Patrick R. McCammon, Cedar Rapids; Louis W. Blackburn, Norway; Bernard J. Hershberger, Marengo, all of Iowa

[73] Assignee: Amana Refrigeration, Inc., Amana, Iowa

[21] Appl. No.: 731,215

[22] Filed: May 7, 1985

[51] Int. Cl.[4] ..... H05B 6/72

[52] U.S. Cl. ..... 219/10.55 F; 219/10.55 R

[58] Field of Search ..... 219/10.55 F, 10.55 R, 219/10.55 E

[56] References Cited

U.S. PATENT DOCUMENTS 4,354,084 10/1982 Husslein et al. ..... 219/10.55 R
4,421,968 12/1983 Osepchuk ..... 219/10.55 F
4,430,538 2/1984 Suzuki et al. ..... 219/10.55 F
4,436,973 3/1984 Ikeda et al. ..... 219/10.55 R X
4,476,362 10/1984 Kusunoki et al. ..... 219/10.55 F

*Primary Examiner*—Philip H. Leung
*Attorney, Agent, or Firm*—William R. Clark

[57] ABSTRACT

A microwave oven cavity air flow system having a grease shield adapted for receiving a nominal flow of air and efficiently using that flow to rotate the antenna and to remove moisture from the cavity. The air is first concentrated into a directive stream which impinges the vanes of the antenna rotating structure. Then, the air is directed into a dispersed flow towards the front of the grease shield wherein a first portion is directed down along the door and a second portion is directed back along the underside of the grease shield to directly transfer water vapor rising from the food to a rear exhaust. The grease shield has a channel for receiving an antenna mounting cradle.

13 Claims, 10 Drawing Figures

FIG. 7
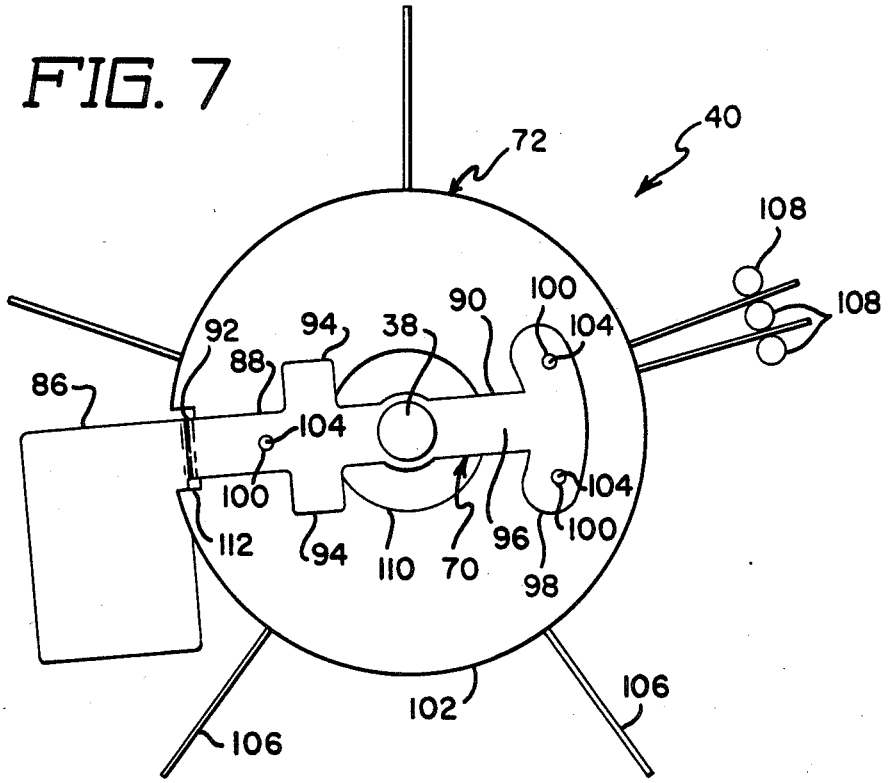
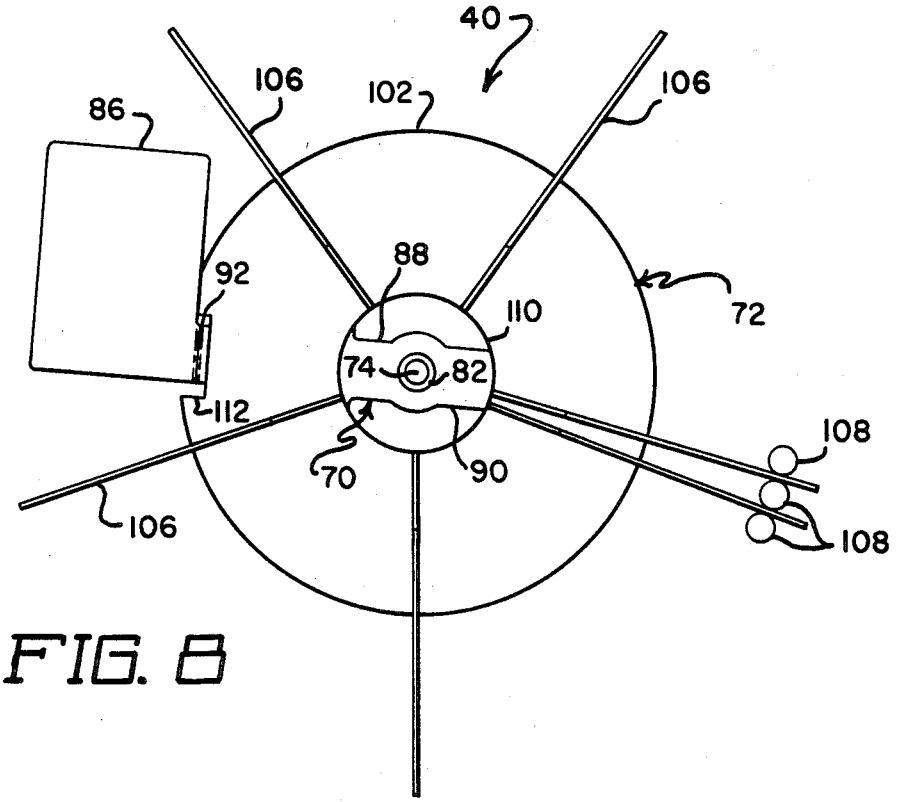
FIG. 8

MICROWAVE OVEN CAVITY AIR FLOW SYSTEM

BACKGROUND OF THE INVENTION

It is well known that it is desirable to force a flow of air through the cavity of a microwave oven to remove water vapor. More specifically, unlike a conventional thermal oven where the walls are hot and the air rises through a vent by natural convection, the air and walls in a microwave oven are relatively cool. Accordingly, without a forced flow of air, moisture given off by the food in a microwave oven tends to condense on the walls, door, or on the food. Further, the rate of release of moisture from the food in a microwave oven is normally much faster than in a thermal oven because the cooking process is generally performed in a much shorter time period.

Because a blower is required to cool the magnetron, it has been common practice to channel at least a portion of the forced convection air from the magnetron into the cavity. The path has been through small perforations in the waveguide or in a cavity wall so as to prevent the escape of microwave energy from the cavity. The static pressure differential between the cavity and the outside causes the air to exhaust through another set of perforations in the cavity carrying with it moisture from the cavity.

It has also been known that it is desirable to rotate either a mode stirrer or a microwave antenna so as to provide more uniform time averaged spatial distribution of energy in the cavity. Although motors have been used to rotate stirrers and antennas, it has been common practice to rotate them by directing an air stream against them. In one prior art approach such as described in U.S. Pat. No. 4,335,289, channels formed by vertical partitions on a plastic grease shield direct input air to swirl against the vanes of a turbine used to rotate the antenna. A drawback of that grease shield, however, was that it did not efficiently or uniformly distribute the flow of air. More specifically, when a cradle was connected to the cavity ceiling to support the antenna and turbine assembly, the rotation rate of the antenna was relatively slow. This was particularly disadvantageous because the rate at which the door is scanned by leakage measuring equipment during manufacturing is determined by the antenna rotation rate. Also, when the flow of air into the cavity was reduced to improve external cooling of electrical components, the inefficiency of the air flow through the cavity resulted in condensation of moisture on the cavity walls and door.

SUMMARY OF THE INVENTION

It is an object of the invention to provide efficient distribution of air forced into the cavity for removing water vapor.

It is another object of the invention to provide efficient distribution of air forced into the cavity for rotating a microwave feed structure.

Still another object of the invention is to maximize the rotation rate of the microwave feed structure. It is a more specific object to provide substantially laminar flow for rotating the feed structure and for removing water vapor rising from the food.

It is also an object to provide a first stream of air down along the door and a second stream of air back along the underside of the grease shield. It is an object that the flow down across the door be substantially uniform.

These and other objects are provided in accordance with the invention which defines a microwave oven comprising a microwave cavity having a ceiling, a rotatable energy coupling member having vanes, said coupling member being located in the cavity adjacent to the ceiling, a grease shield comprising a panel substantially separating the cavity into an upper chamber housing the rotatable coupling member and a lower cooking chamber, means for forcing air into the upper chamber, the grease shield comprising means for channelling said air forced into said upper chamber into a directive stream directed at the vanes for rotating the coupling member, the grease shield further comprising means for transforming the stream of air into a substantially uniform dispersed flow of air travelling toward the front of the grease shield for transmission down into the lower chamber, and means for exhausting air from the lower chamber of the cavity. The rotatable microwave energy coupling member may define a mode stirrer for a primary radiator such as a directive antenna. It may be preferable that the oven further comprise a cradle for supporting the rotatable microwave energy coupling member wherein the cradle has legs suspended from the ceiling and a cross bar from which the coupling member is supported. Also, the panel and the grease shield may have a channel for receiving the cross bar. Further, it may be preferable that the channelling and transferring means comprise vertical partitions extending between the panel and the ceiling and connected to the panel.

The invention may further be practiced by a microwave oven comprising a microwave cavity having side walls, a back wall, a floor, a ceiling and a front door, a rotatable microwave energy coupling member having vanes, the coupling member being located in the cavity adjacent to the ceiling, a grease shield comprising a panel substantially separating the cavity into an upper chamber housing the rotatable coupling member and a lower cooking chamber, means for forcing air into the upper chamber, the grease shield comprising means for channelling the air forced into the upper chamber into a directive stream directed at the vanes for rotating the coupling member, the grease shield further comprising means for transforming the stream into a substantially uniform dispersed flow of air travelling toward the front of the grease shield, the grease shield further comprising means for directing a portion of the dispersed flow downwardly into the lower chamber of the cavity along the door, the grease shield further comprising means for directing a second portion of the dispersed flow backwardly along the underside of the grease shield in the lower chamber of the cavity, and means for exhausting air from the cavity. The channel may preferably have a sloped front side so that the air passing back along the underside is laminar instead of turbulent. The means for transforming the stream into a dispersed flow may preferably comprise a vertical partition having a downward slope.

BRIEF DESCRIPTION OF THE DRAWINGS

The foregoing objects and advantages will be more fully understood by reading the Description of the Preferred Embodiment with reference to the drawings wherein:

FIG. 7 is a top view of the microwave feed assembly;

FIG. 8 is a bottom view of the microwave feed assembly;

DESCRIPTION OF THE PREFERRED EMBODIMENT

Figure 1:
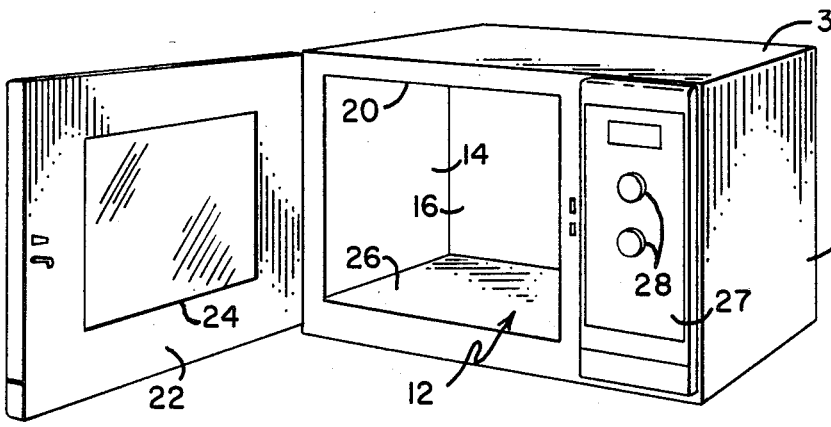
FIG. 1 is a front perspective view of a microwave oven.

Referring to FIG. 1, a front perspective view of a microwave oven 10 is shown. The cavity 12 of microwave oven 10 is generally defined by side walls 14, back wall 16, floor 18 (FIG. 3), ceiling 20 and door 22 which preferably includes a window 24 for observing the cooking. Door 22 also includes a suitable choke for preventing the escape of microwave energy from microwave cavity 12. A microwave transparent support tray 26 is elevated above floor 18. A control panel 27 including control knobs 28 is provided for activating and controlling the source of microwave energy such as magnetron 30 (FIG. 2) in conventional manner. Top and side casing 32 surrounds the outside of microwave oven 10.

Figure 2:
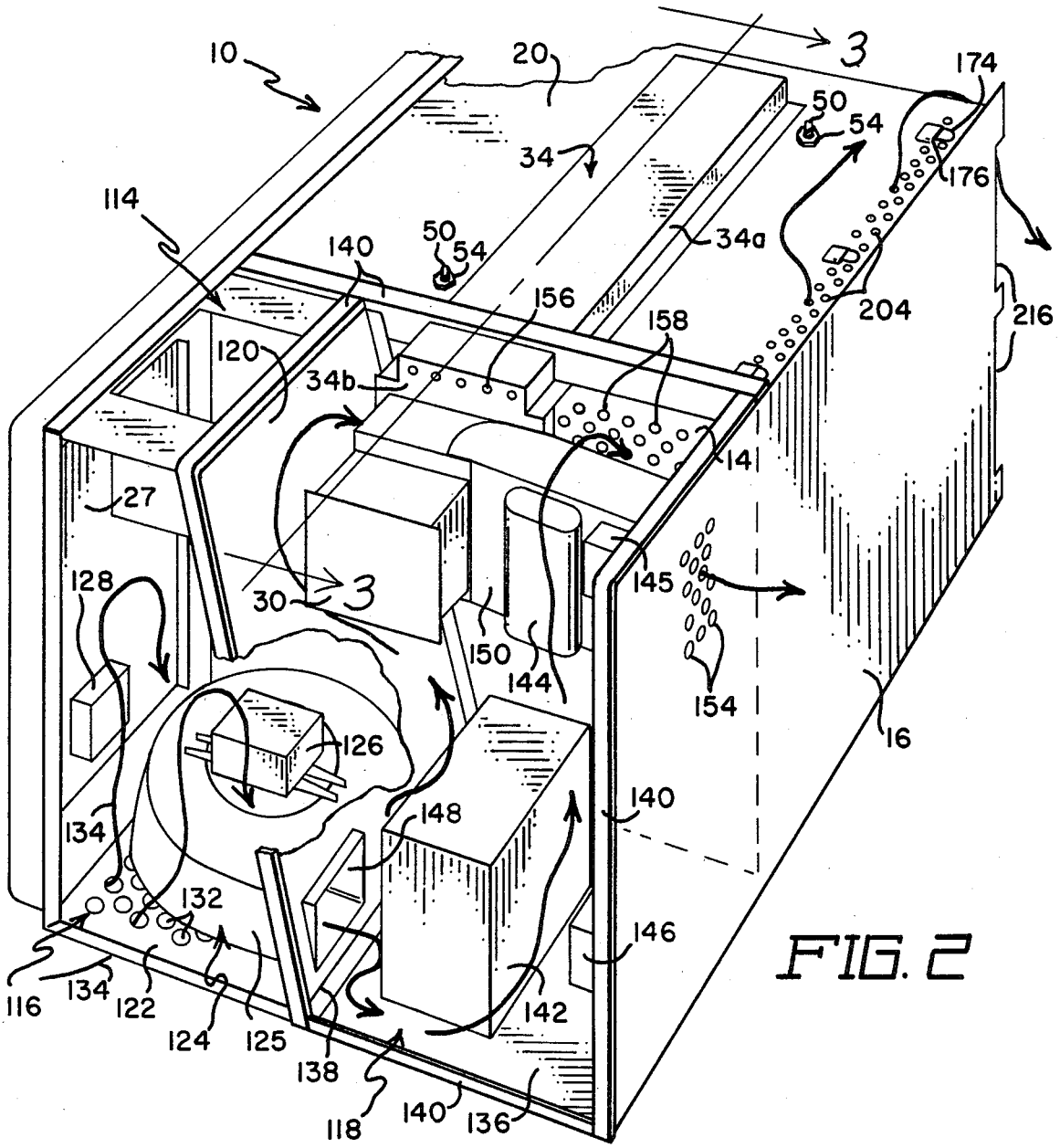
FIG. 2 is a side rear partially broken away perspective view of the microwave oven with the top and side casing removed.
Figure 3:
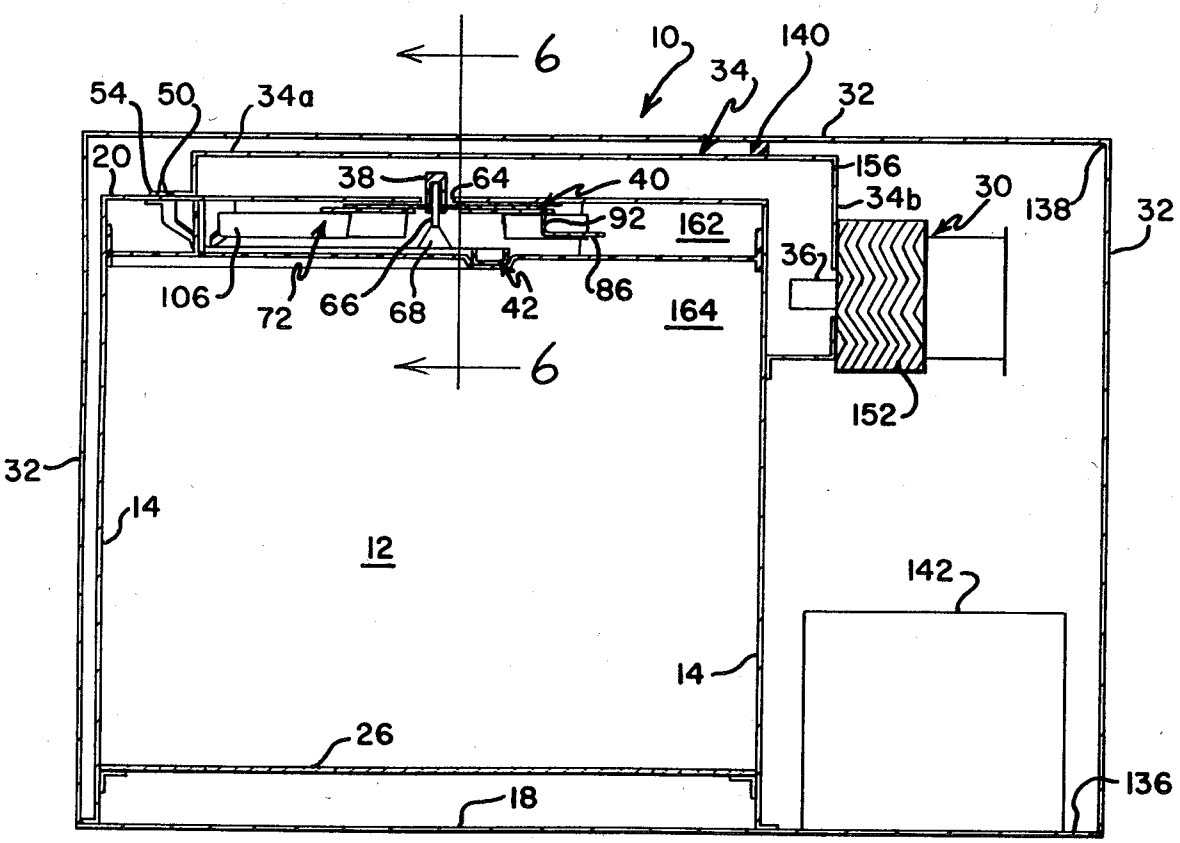
FIG. 3 is a front sectional view of the oven.

Referring to FIG. 2, there is shown a partially brokenaway right rear perspective view of microwave oven 10 with top and side casing 32 removed. FIG. 3 shows a front sectional view of microwave oven 10. Waveguide 34, which is parallel to back wall 16, consists of a horizontal section 34*a* running across the top of ceiling 20 and a vertical section 34*b* along the right side wall 14. The output probe 36 of magnetron 30 inserts into vertical section 34*b* to which the magnetron 30 is mounted. When magnetron 30 is activated in response to control knobs 28, microwave energy at a frequency such as, for example, 2450 MHz travels up waveguide vertical section 34*b*, across waveguide horizontal section 34*a* and excites antenna probe 38 for coupling into cavity 12. Waveguide section 34*a* extends considerably past antenna probe 38 to increase the rigidity of ceiling 20. The precise length of waveguide section 34*a* is selected to optimize the impedance match and power transfer to antenna probe 38.

Figure 4:
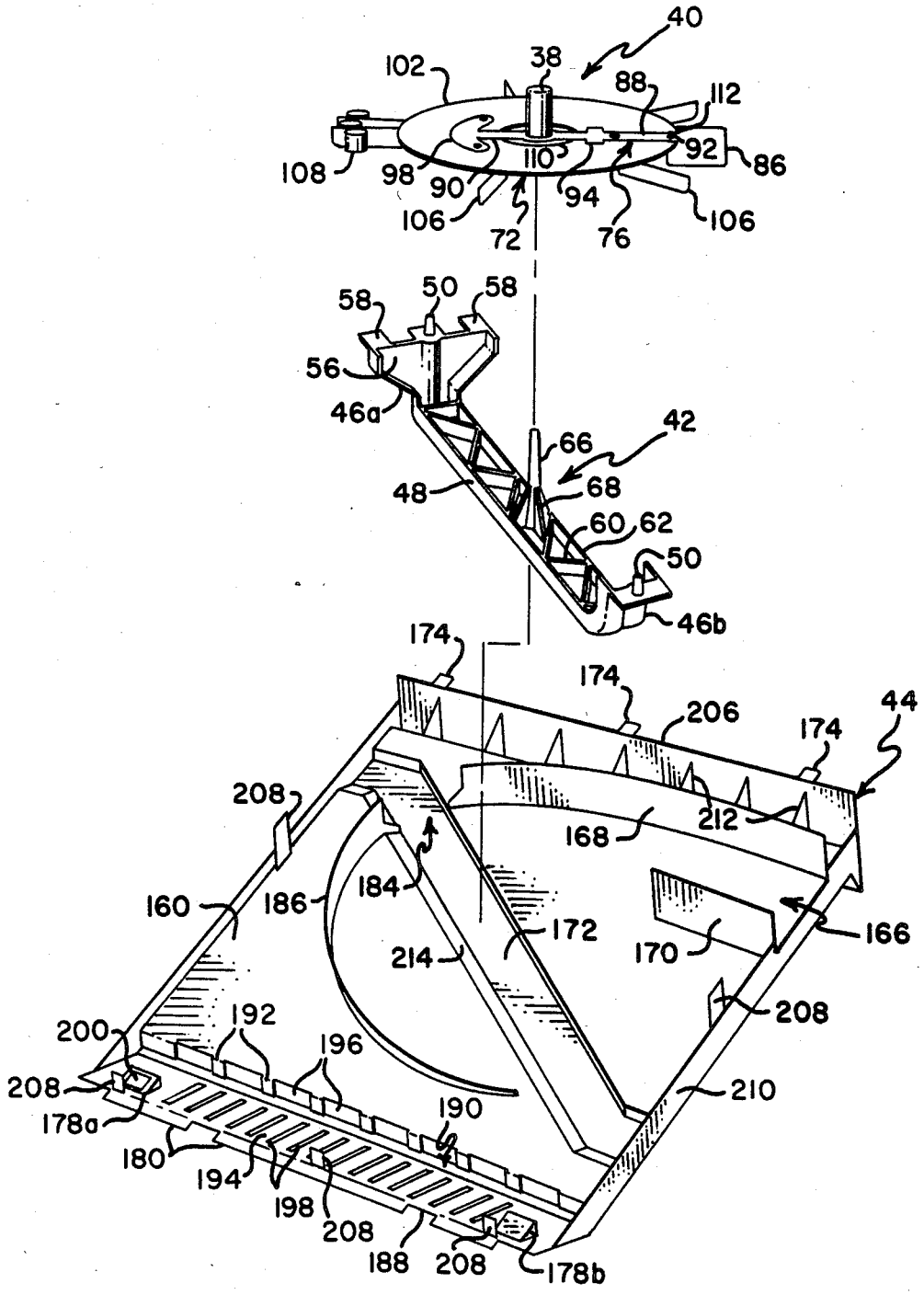
FIG. 4 is an exploded view of the microwave feed assembly, cradle, and grease shield.
Figure 5:
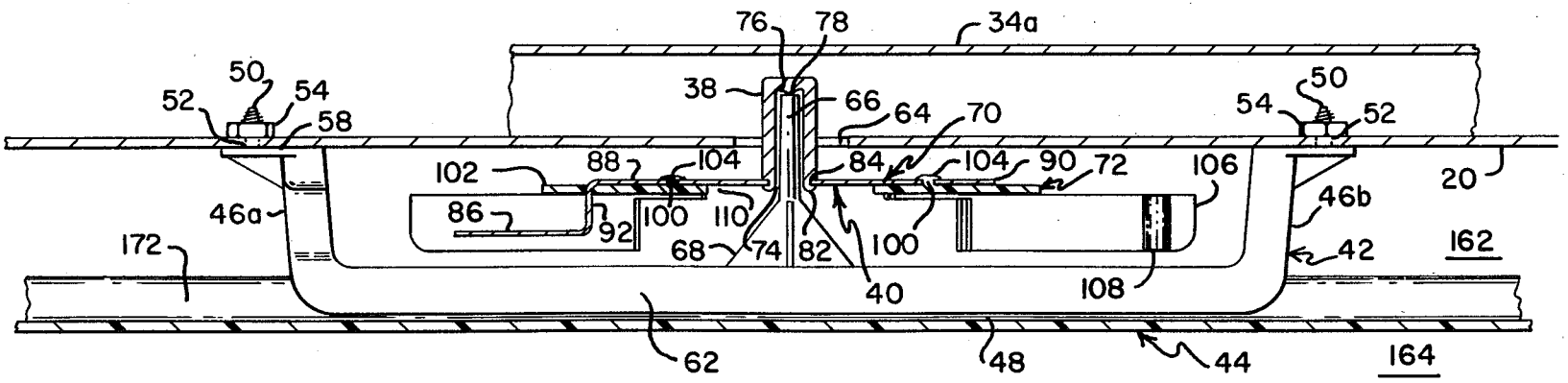
FIG. 5 is a sectioned elevation view taken along the cradle.
Figure 6:
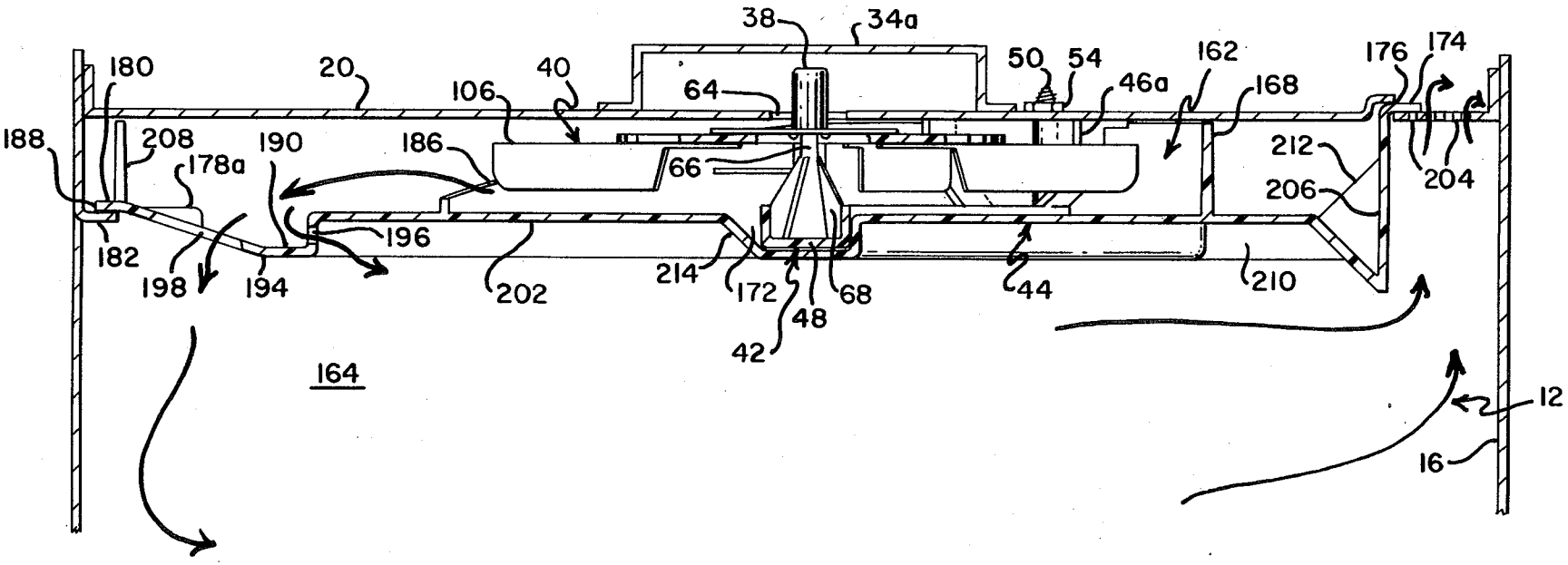
FIG. 6 is a side elevation view taken along line 6—6 of FIG. 3.

Referring to FIG. 4, an exploded view of microwave feed assembly 40, mounting cradle 42 and grease shield 44 are shown. Referring to FIGS. 5 and 6, sectional elevation views taken along cradle 44 and along line 6—6 of FIG. 3 are shown. Cradle 42, which is molded from a microwave transparent material such as plastic, has two legs 46*a* and 46*b* with a horizontal cross bar or arm 48. Each leg 46*a* and 46*b* has a pin 50 or fastening post which inserts up through a small hole 52 in ceiling 20 for engagement by a suitable fastener such as a nut 54 or clip. Leg 46*a* has wings 56 which extend to platforms 58 which seat against ceiling 20 to secure the attitude of cradle 42. Horizontal arm 48 is here shown with diagonal struts 60 and side slats 62 to make it rigid. Arm 48 of cradle 42 is mounted oblique to waveguide 34 and extends underneath circular aperture 64 which communicates from waveguide horizontal section 34*a* to cavity 12. A vertical support post 66 with braces 68 extends upwardly from horizontal arm 48 and inserts through aperture 64. The oblique mounting of cradle 42 helps to prevent bending or "oil canning" of ceiling 20 altering the alignment of supporting post 66 and aperture 64. More specifically, the angle between cradle 42 and the axis of waveguide 34 is relatively small to more securely locate supporting post 66 in the center of aperture 64; in one embodiment where cradle 42 was mounted perpendicular to waveguide 34, ceiling 20 buckled slightly and the downward bow altered the alignment between supporting post 66 and aperture 64. For illustration, cradle 42 may have a length of approximately 10 inches and legs 46*a* and 46*b* may space horizontal arm 48 about $1\frac{1}{8}$ inches from ceiling 20. Also, supporting post 66 may extend up into waveguide 34 approximately $\frac{1}{2}$ inch and have an upper flat diameter of 0.175 inches tapering outwardly to a diameter of 0.196 inches approximately $\frac{3}{4}$ inches below.

Now, with additional reference to FIGS. 7 and 8, there are shown top and bottom views, respectively, of microwave feed assembly 40 which includes antenna probe 38, conductive strip 70 and microwave transparent turbine 72. As shown best in FIG. 5, antenna probe 38 is a cylindrical stub having a bottom axial bore 74 which is placed over support post 66. The roof 76 of bore 74 which supports microwave feed assembly 40 on support post 66 has a downwardly extending ball 78 or spherically shaped protrusion for minimizing the contact area and rotational friction between the bearing surfaces. As an example, bore 74 may have a length of approximately 0.8 inches with a top diameter of 0.19 inches tapering outwardly to approximately 0.21 inches. The outer diameter of antenna probe 38 may be $\frac{1}{2}$ inch. The bottom of antenna probe 38 has a flange 82 which inserts through hole 84 in conductive strip 70 and then is secured thereto by an orbital peen.

Still referring to FIGS. 5, 7, and 8, conductive strip 70 includes a flag or patch antenna 86, a strip conductor 88 and a strip support 90 or strip connector. Conductive strip 70 is punched or cut from a flat sheet of aluminum alloy having a thickness of approximately 0.032 inches. Flag antenna 86 defines a rectangle having rounded corners. In the direction of strip conductor 88, flag antenna 86 has a dimension of 1.281 inches with a transverse dimension of 1.968 inches. From hole 84, strip conductor 88 has a horizontal length of approximately 2 inches to a downwardly bent section 92 which spaces flag antenna 86 approximately 0.5 inches below the plane of the rest of strip conductor 88. Strip conductor 88 is spaced approximately 0.3 inches from ceiling 20 so flag antenna 86 is spaced approximately 0.8 inches. Strip conductor 88 has two outwardly extending tabs 94 on opposing sides approximately 0.625 inches from hole 84. Tabs 94, which extend outwardly approximately 0.375 inches for a distance of 0.5 inches enhance the impedance match between antenna probe 38 and flag antenna 86. Strip support 90 has a segment 96 approximately 1.3 inches long to a curved anchor segment 98. Conductive strip 70 has three holes 100 to connect it to turbine 72. More specifically, turbine 72 has a horizontal disk 102 with three bosses 104 which are aligned with holes 100. In connecting plastic turbine 72 to conductive strip 70, the bosses 104 are respectively inserted up through holes 100 and then melted or ultrasonically welded for permanent attachment. On the bottom side of disk 102, turbine 72 has a plurality of vertical radial vanes 106 or paddles which cause microwave feed assembly 40 to rotate when impinged by a stream of air as will be described in detail later herein. Vanes 106 may have weights 108 to balance microwave feed assembly 40 about its vertical axis of rotation through hole 84 and antenna probe 38. The radius of each vane 106 from the axis of rotation is approximately 3.75 inches. Disk 102 has a central aperture 110 through which orbital peened flange 82 extends. Also, disk 102 has a notch 112 where vertical section 92 of strip conductor 88 extends downwardly.

In operation, the microwave energy in waveguide 34 excites microwave currents on antenna probe 38 thereby coaxially coupling the energy down antenna probe 38 through circular aperture 64 to the junction with conductive strip 70. Most of the microwave current conducts in the direction of strip conductor 88 rather than strip support 90 because the described geometry of strip support 90 has a high input impedance. More specifically, the oppositely directed arms of anchor segment 98 are joined in parallel to provide a low impedance which transforms to a high impedance at the input to strip support 90 which is approximately a quarter wavelength away. The two arms of anchor segment 98 should not total a half wavelength because that could cause high field strength and possible arcing if cavity 12 were operated without a load. There is very little radiation of microwave energy along strip conductor 88 because, as shown best in FIG. 5, it is closely spaced to ceiling 20 which functions as a ground plane or plate. More specifically, strip conductor 88 is parallel and spaced approximately 0.3 inches or less than one-eighth wavelength from from ceiling 20 so that it is equivalent to an air dielectric microstrip line. According to well-known principles, the closely spaced ground plate or reflector maximizes transmission and minimizes radiation. Strip support 90 is also closely spaced to ceiling 20 so that the relatively small currents traveling in that direction would have a high radiation resistance.

The microwave currents travel down the 0.5-inch vertical length of strip section 92 to flag antenna 86. Because the flag antenna 86 is spaced approximately 0.8 inches or substantially more than one-eighth wavelength below ceiling 20 which functions as a ground plane, flag antenna 86 is an effective radiator of microwave energy. Radiation from flag antenna 86 is also enhanced because it is resonant thereby increasing the current flow. The long dimension of the rectangle of flag antenna 86 which is 1.968 inches long is resonant at a frequncy F1 below the operating frequency; accordingly, the current in that direction lags the excitation voltage. The short dimension of the rectangle of flag antenna 86 which is 1.281 inches long is resonant at a frequency F2 above the operating frequency; accordingly, the current in that direction leads the excitation voltage. With these rectangle dimensions in the described cavity environment, flag antenna 86 provides a pattern with substantially circular polarization over a relatively large angle. More specifically, the orthogonal components radiated from flag antenna 86 are substantially equal in magnitude and their phases have a difference of approximately 90°. The dimensions of flag antenna 86 were empirically determined by using rectangles of different dimensions as radiating antennas and measuring the relative signal strengths and phases received with a linearly polarized antenna alternately held parallel to the two orthogonal directions of the rectangles. The results of the tests were plotted as functions of the lengths of the sides. Intensity contours of equal magnitude and 90° phase differences were estimated from the data to obtain the optimum dimensions.

Ideally, the maximum orthogonal current amplitudes and the radiated components at resonant frequencies F1 and F2 are equal such that F1 and F2 could be displaced such that their respective half power points occur at the operating frequency so that the current of one leads the excitation by 45° and the current of the other lags the excitation voltage by 45°. In this way, the currents in the orthogonal directions would have a phase differential of 90°. However, even if the maximum radiated components at resonant frequencies F1 and F2 are unequal, the dimensions of the rectangle of flag antenna 86 can be selected such that resonant frequencies F1 and F2 are moved up or down from the ideal F1 and F2 frequencies to compensate. More specifically, for a strong F1 excitation, resonant frequencies F1 and F2 are moved down in frequency to provide equal radiated components with a phase difference of 90° at the operating frequency; for a strong F2 excitation, resonant frequencies F1 and F2 are moved up in frequency to provide equal radiated components with a phase difference of 90° at the operating frequency.

Many other embodiments of flag antennas and feed structures could be used to radiate substantially circular polarization into cavity 12. For example, flag antenna 86 could be oblique to strip section 92 rather than at a right angle. Also, strip section 92 could be perpendicular to the short side rather than to the long side or it might be connected anywhere along either side. Further, the width of strip section 92, here 0.5 inches, could be different and it could have a different length. Also, a plurality of flag antennas 86 could be used. It should be recognized, however, that the optimum dimensions of flag antenna 86 are a function of the operating environment. Accordingly, each one of the described modifications would alter resonant frequencies F1 and F2 and the currents in the two orthogonal directions parallel to the sides of the rectangle. As a result, the dimensions of the flag antenna 86 should be optimized for circular polarization with each configuration.

Because flag antenna 86 is supported by strip conductor 88 rather than a solid dielectric as is commonly used in microstrip patch antennas for radars, flag antenna 86 can be moved freely with respect to ceiling 20 which functions as its ground plane. More specifically, as will be described in detail later herein, flag antenna 86 is rotated about the axis of antenna probe 38 thereby moving the radiated pattern in an offset circular path. Also, the air dielectric between the flag antenna 86 and ceiling 20 stores less energy than a solid dielectric. Accordingly, the operating bandwidth for both radiation and circular polarization is enhanced. While the microwave oven operates in only a narrow band of allowed frequencies, the resonant frequency of the flag antenna 86 is determined, among other things, by its physical size and spacing from ceiling 20. Accordingly, the wider bandwidth increases the tolerance on dimensional variations and positioning of flag antenna 86.

Flag antenna 86 has a lower profile than a helical antenna having a cylindrical segment for providing circular polarization by gradually increasing the spacing from the ground plane. The low profile increases the usable volume of cavity 12 and also permits flag antenna 86 to be rotated above cross arm 48 of a support cradle 42 which has relatively short legs **46*a* and 46*b***.

Again referring to FIG. 2, divider panel 120 separates the chamber 114 behind control panel 27 into a front control compartment 116 and a back power supply compartment 118 or plenum. More specifically, control compartment 116 is bounded by control panel 27, partition or divider panel 120, top and side casing 32, cavity side wall 14, and bottom 122. Blower 124 which includes scroll 125 and motor 126 is positioned in control compartment 116 and, as will be described in detail, provides a forced flow of air for cooling components, for rotating microwave feed assembly 40, and for removing moisture from cavity 12. Control compartment 116 also encases conventional controls 128 such as relays, timers, circuit boards, and interlocks for microwave oven 10. The intake air for blower 124 may be drawn or sucked into control compartment 116 through a variety of passageways such as, for example, openings 132 in bottom 122. Only a relatively small amount of heat is generated in the control compartment 116 and that heat is effectively removed by intake air 134 being drawn across blower motor 126 and controls 128 on its way to scroll 125.

Power supply compartment 118 is an enclosure generally defined by divider panel 120, top and side casing 32, cavity side wall 14, back wall 16 and bottom 136. The seams 138 of power supply compartment 118 are substantially sealed by gasket 140 so that a static pressure differential can be built up between the power supply compartment 118 or plenum and the outside. In addition to power supply components, power supply compartment 118 houses magnetron 30 and may also enclose other components such as a fuse board and an oven light (not shown). More specifically, power supply compartment 118 is here shown housing power transformer 142 and condenser 144 which, along with a rectifier 145, are part of a conventional voltage doubler circuit for providing high voltage such as 4,000 volts to magnetron 30. Also, conventional filament transformer 146 is shown mounted to back wall 16 in power supply compartment 118. The forced air from blower 124 is coupled directly to a chute or aperture 148 through divider panel 120. Power transformer 142 is mounted adjacent to aperture 148 and transverse to the direction of flow of forced convection air from aperture 148. Accordingly, turbulent and relatively high velocity cooling air from blower 124 impinges power transformer 142 first upon entering power supply compartment 118. As a result, the rate of heat flow by convection from power transformer 142 is greater than in prior art microwave ovens. For example, in one prior art embodiment where relatively low velocity substantially laminar air was drawn across a particular power transformer on its way to the blower, the power transformer had a temperature rise in the range from 120° C. to 131° C. That same power transformer 142, however, was found to have a temperature rise of only about 64° C. when mounted in power supply compartment 118 as described herein. As a result of more effective cooling, the size of the power transformer 142 can be reduced without exceeding the maximum allowable temperature standards of approval agencies. The reduced size not only lowers the cost of materials, but it results in less weight which equates to significant advantages in shipping and portability. Another advantage of the above-described embodiment is that the blower motor 126 is positioned in control compartment 116 isolated from the higher heat producing components in the power supply compartment 118. Filament transformer 146 along with condenser 144 and rectifier 145, which are mounted on discharge air duct 150, are cooled by the forced convection air after it flows across power transformer 142.

The convection air forced through aperture 148 by blower 124 creates a static pressure differential between the interior of power supply compartment 118 or plenum and the outside. Accordingly, air flows outwardly from power supply compartment 118 by any available path. Because the seams 138 of power supply compartment 118 are substantially sealed against the passage of air, the air primarily exhausts from power supply compartment 18 through three predetermined and well defined paths or passageways. The first path is through cooling fins 152 of magnetron 30 which communicate through discharge air duct 150 to exhaust ports 154 on back wall 16. The air flow through this first path has to be large enough to provide adequate cooling of magnetron 30. The second path enters perforations 156 in waveguide vertical section **34*b* and flows down the waveguide where it enters cavity 12 through aperture 64; the relatively small air flow in this second path provides some cooling of the magnetron output probe 36. The third path enters cavity 12 through a set of perforations 158 in side wall 14 near ceiling 20. As will be described in detail, the functions of the air flow along the third path are to rotate microwave feed assembly 40 and to remove moisture from cavity 12. Because all of the air entering power supply compartment 118 is directed through aperture 148, the rate of air flow at the power transformer 142 is equal to or greater than the rate of air flow at magnetron 30. For example, the cubic feet per minute of air flowing through aperture 148 is approximately equal to sum of the cubic feet per minute air flow rates through the three described exit paths. Because the air flowing through magnetron 30 is only one of those exit paths, its rate would never be larger than the input rate through aperture 148**.

Figure 9:
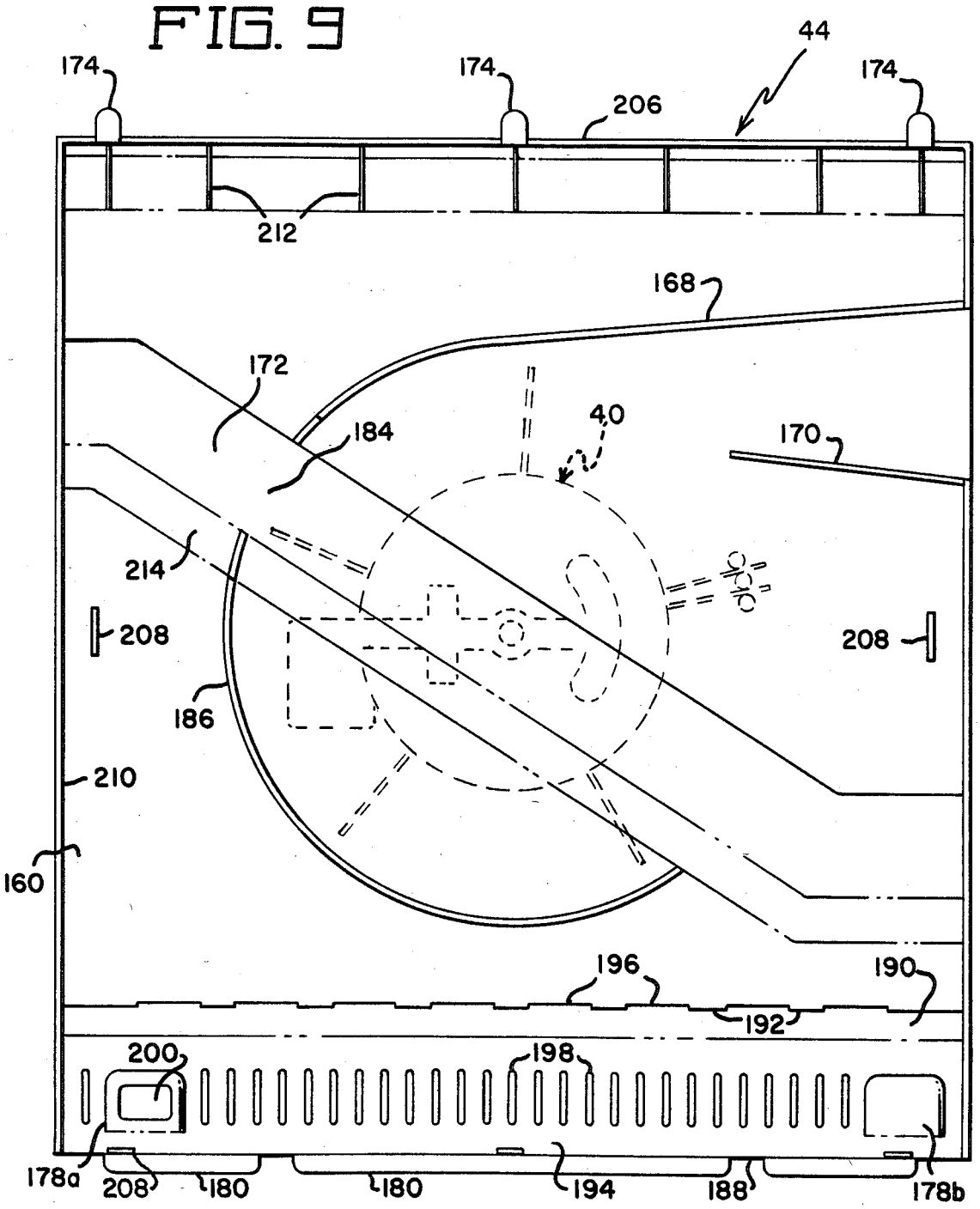
FIG. 9 is a top view of the grease shield depicting the alignment of the microwave feed assembly.
Figure 10:
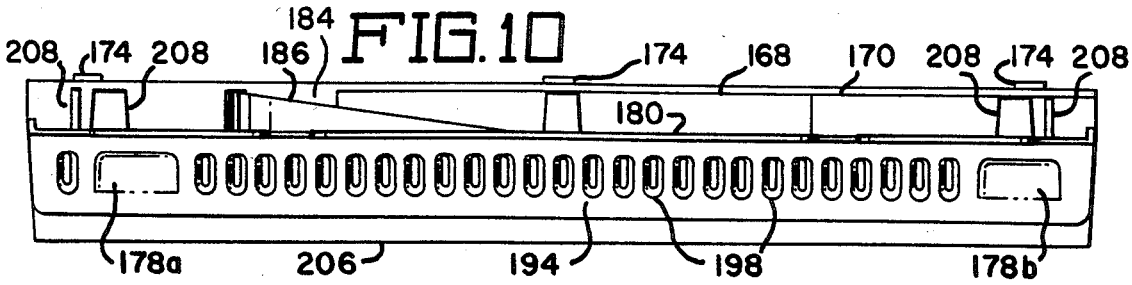
FIG. 10 is a front view of the grease shield.

As described earlier herein, FIG. 4 shows an exploded view including grease shield 44 which may be a plastic molded part. FIG. 6 shows a side sectioned elevation view of cavity 12 and grease shield 44. FIGS. 9 and 10 respectively show top and front views of grease shield 44. FIG. 9 also depicts the alignment of microwave feed assembly 40. Grease shield 44 directs the flow and distribution of air in cavity 12 so as to rotate microwave feed assembly 40 and exhaust moisture from cavity 12. Because a significant portion of the forced air from blower 134 is exhausted through magnetron 30 to exhaust port 154, there is only a limited amount of air forced through perforations 158 into cavity 12. Accordingly, grease shield 44 must make efficient and effective use of the air in performing its intended functions. Grease shield 44 has a substantially horizontal panel 160 which divides cavity 12 also an upper region or chamber 162 housing microwave feed structure 40 and a lower cooking region or chamber 164. The air from perforations 158 flows by static pressure differential into nozzle or chute 166 formed by horizontal panel 160, ceiling 20 and interconnecting vertical partitions 168 and 170 or dividers. The spacing between partitions 168 and 170 may be closer at the inside such as 2.125 inches as compared to 2.5 inches so that the air is concentrated into a relatively high velocity stream of air directed tangentially at the vanes 106 of turbine 72. Panel 160 has an oblique channel 172 aligned for receiving the arm 48 of cradle 42. If cradle 42 were not recessed in channel 172, the stream of air driving turbine 72 would become turbulent upon impinging side slat 62. Laminar flow, on the other hand, helps to increase the speed of rotation of microwave feed assembly 40. In fact, because of substantially laminar flow and the low rotational friction provided by ball 78, microwave feed assembly may rotate at approximately 120 rpm. This fast rotation is especially advantageous because the scan rate of leakage testing equipment used during manufacturing is determined by the rate of antenna rotation. For example, at 120 rpm, the scan rate along the door can be 2 inches per second. At 60 rpm, however, the scan must be 1 inch per second.

Channel 172 is enough wider than arm 48 of cradle 42 so that grease shield 44 can easily be installed or removed without contacting or disturbing cradle 42. More specifically, as described best with reference to FIG. 6, grease shield 44 is initially installed and then later removed and replaced for cleaning by inserting tabs 174 into suitable receptacles 176, here slots in ceiling 20, and then pushing backward in thumb holds 178*a* and 178*b* to slightly bend grease shield 44 so that front tabs 180 can be inserted or snapped over flange 182 of cavity 12. If the tolerance of channel 172 and cradle 42 were too small, installation and removal of grease shield 44 would be encumbered.

Partition 168 extends approximately out to channel 172 while partition 170 stops short of the rotational circumference defined by vanes 106. Wings 56 of leg 46*a* approximately conform with the gap 184 between partition 168 and partition 186. Accordingly, most of the air stream driving turbine 72 continues inside partition 186 rather than being directed through gap 184.

Partition 186 and a portion of partition 168 adjacent channel 172 are arcs concentric to the rotational circumference defined by vanes 106. Each arc has a radius of 4.125 inches. From a point approximately 15° to the front of a lateral axis through the center of rotation, the height of partition 186 has a downward linear slope from approximately 1.123 inches where it contacts ceiling 20 to approximately 0.087 inches at its juncture with channel 172 on the right. Accordingly, the air driving stream flows out over partition 186 and it is dispersed with relative uniformity toward the front 188 of grease shield 44. More specifically, where the air stream is strongest, the space between ceiling 20 and partition 186 is smallest to limit the air flowing toward the left front. As the air stream gets weaker in the counter clockwise direction due to dissipation, the space between ceiling 20 and partition 186 gets larger to equalize the air flowing toward the right front.

The uniformly dispersed flow of air from partition 186 travels forward to trough 19 defined by vertical side 192 and sloped front side 194. Vertical side 192 has a plurality of lateral slots 196 and sloped side 194 has a plurality of front-to-back slots 198. The air entering trough 190 by static pressure differential flows from upper chamber 162 to lower cooking chamber 164 through slots 196 and 198. The path initiated from slots 198 flows down along the door and is important to prevent condensation of moisture on window 24 that would reduce visibility of cavity 12. Although partition 186 is sloped downwardly to provide substantially uniform distribution of air flow down along door 22, it was found that the air flow adjacent to the left side was slightly less than the rest resulting in some condensation there. Accordingly, an aperture 200 was located in the left thumb hold 178*a* and the distribution of air flow down door 22 was made more uniform. As shown best in FIG. 6, the path of air flow initiated from slots 196 is directed back along the underside 202 of grease shield 44 to efficiently and directly exhaust moisture rising from the food. More specifically, if the rising moisture is exhausted directly rather than being dispersed throughout the cavity, the limited air flow is utilized more effectively and efficiently. The air carrying moisture from cavity 12 passes back along the underside 202 and then exhausts through a set of perforations 204 in the ceiling 20 behind the back partition 206 of grease shield 44. The bottom of back partition 206 extends downwardly below the horizontal plane of panel 160 so as to shield perforations 204 from direct splatter of grease. In addition to at least portions of partitions 168, 170, 186 and 206, spacers 208 contact ceiling 20 so as to limit the warping of grease shield 44. Side slats 210 and ribs 212 function as braces to increase the rigidity of grease shield 44. The front side 214 of channel 172 is sloped so as to reduce the turbulence of air flowing across it; the laminar flow provides a more effective use of the limited air flow.

As shown best in FIG. 2, the air exhausting cavity 12 up through perforations 204 flows laterally between the top of ceiling 20 and the top casing 32 to the left side. Then, the air flows downwardly to oven exhaust vents 216. In conformance with safety requirements, the indirect flow of air from cavity 12 prevents flames from coming out of microwave oven 10 in the unlikely event that a fire was burning in the cavity 12.

This concludes the description of the preferred embodiment. A reading of it by those skilled in the art will bring to mind many modifications and alternate without departing from the spirit and scope of the invention. Accordingly, it is intended that the invention only be limited by the following claims.

What is claimed is:

1. A microwave oven, comprising:

a microwave cavity having a ceiling;

a rotatable microwave energy coupling member having vanes, said coupling member being located in said cavity adjacent said ceiling;

a cradle for supporting said rotatable microwave energy coupling member, said cradle having legs suspended from said ceiling and a cross bar;

a grease shield comprising a panel substantially separating said cavity into an upper chamber housing said rotatable coupling member and a lower cooking chamber;

means for forcing air into said upper chamber;

said grease shield comprising means for channeling said air forced into said upper chamber into a directive stream directed at said vanes for rotating said coupling member, said panel of said grease shield having a channel for receiving said cross bar for limiting the turbulence induced in said directive stream;

said grease shield further comprising means for transforming said stream into a substantially uniform dispersed flow of air traveling toward the front of said grease shield for substantially uniform lateral transmission down into said lower chamber; and said channeling and transforming means comprising vertical partitions, said vertical partition of said transforming means being sloped; and means for exhausting air from said lower chamber of said cavity.

2. A microwave oven, comprising:

a microwave cavity having sidewalls, a back wall, a floor, a ceiling, and a front door;

a rotatable microwave energy coupling member having vanes, said coupling member being located in said cavity adjacent said ceiling;

a grease shield comprising a panel substantially separating said cavity into an upper chamber housing said rotatable coupling member and a lower cooking member;

means for forcing air into said upper chamber;

said grease shield comprising means for channeling said air forced into said upper chamber into a directive stream directed at said vanes for rotating said coupling member;

said grease shield further comprising means for transforming said stream into a substantially uniform dispersed flow of air traveling toward the front of said grease shield;

said grease shield further comprising means for directing a portion of said dispersed flow downwardly into said lower chamber of said cavity along said door;

said grease shield further comprising means for directing a second portion of said dispersed flow backwardly along the underside of said grease shield in said lower chamber of said cavity; and means for exhausting air from said cavity.

3. The oven recited in claim 2 further comprising a cradle for supporting said rotatable microwave energy coupling member, said cradle having legs suspended from said ceiling and a cross bar.

4. The oven recited in claim 3 wherein said panel has a channel for receiving said cross bar.

5. The oven recited in claim 2 wherein said channeling and transforming means comprise vertical partitions connected to said panel.

6. The oven recited in claim 2 wherein said channel has a sloped front side.

7. A microwave oven, comprising:

a microwave cavity having side walls, a back wall, a floor, a ceiling, and a front door;

a waveguide positioned above said ceiling;

means for energizing said waveguide with microwave energy;

a microwave feed positioned in said cavity adjacent said ceiling, said feed comprising a microwave antenna and a plastic turbine having vanes for rotating said antenna;

means for transferring energy from said waveguide to said antenna;

a grease shield comprising a panel substantially separating said cavity into an upper chamber housing said microwave feed and a lower cooking chamber;

means for forcing air into said upper chamber;

said grease shield comprising at least first and second vertical partitions for channeling said air forced into said upper chamber into a directive stream directed at said vanes for rotating said antenna;

said grease shield further comprising a third vertical arcuate partition concentric with the rotational circumference of said vanes, said third vertical partition having a downward slope for transforming said stream into a substantially uniform dispersed flow of air directed towards the front of said grease shield;

said grease shield further comprising a lateral trough at said front for receiving said dispersed flow of air, said trough having a first set of openings for directing a first portion of said air in said trough downwardly into said lower chamber of said cavity along said door, said trough further having a second set of openings for directing a second portion of said air in said trough backwardly along the underside of said grease shield in said lower chamber of said cavity; and means for exhausting air from said lower chamber of said cavity.

8. The oven recited in claim 7 further comprising a cradle for rotatably supporting said microwave feed, said cradle having two arms suspended from said ceiling and a cross bar with a mounting post.

9. The oven recited in claim 8 wherein said panel of said grease shield has a channel for receiving said cross bar to limit the turbulence of said stream flowing across said cross bar.

10. A microwave oven, comprising:

a microwave cavity having side walls, a back wall, a floor, a ceiling, and a front door;

a microwave feed assembly positioned adjacent to said ceiling in said cavity, said microwave feed assembly comprising an antenna, a conductor strip, and a plastic turbine having vanes for rotating said antenna;

a cradle for supporting said microwave feed assembly, said cradle comprising legs suspended from said ceiling and a horizontal arm connected between said legs, said arm having an upwardly extending post for supporting said microwave feed structure;

a grease shield comprising a horizontal panel substantially dividing said cavity into an upper chamber and a lower chamber, said upper chamber housing said microwave feed assembly and said cradle;

said horizontal panel of said grease shield having a channel for receiving said cross arm of said cradle;

means for forcing air into said upper chamber;

means comprising perforations for exhausting air from said lower chamber;

said grease shield comprising first and second partitions for channeling said air forced into said upper chamber into a directive stream for driving said vanes to rotate said antenna;

said grease shield further comprising a third partition for transforming said stream into a dispersed flow directed towards the front of said grease shield, said flow being substantially uniform across said front;

said grease shield further comprising a first set of apertures for directing a first portion of said forward dispersed flow downwardly into said lower chamber past said front door; and said grease shield further comprising a second set of apertures for directing a second portion of said forward dispersed flow backwardly along the underside of said grease shield in said lower chamber of said cavity, wherein said air directed through said first and second sets of apertures exhausts through said air exhausting means in said lower chamber.

11. The oven recited in claim 10 wherein said channel on said underside of said grease shield has a looped front to limit the turbulence of said air flowing backwardly along the underside of said grease shield.

12. The oven recited in claim 11 wherein said first and second sets of apertures are positioned in a lateral trough across the front of said grease shield.

13. The oven recited in claim 10 wherein said third partition is arcuate and concentric to the rotational circumference defined by said vanes, said third partition having a downward slope.

* * * * *